US005333887A

United States Patent [19]

Luther

[11] Patent Number: 5,333,887

[45] Date of Patent: Aug. 2, 1994

[54] WHEELCHAIR/GURNEY

[75] Inventor: Harry M. Luther, Portsmouth, Ohio

[73] Assignee: Joe Sharp, Rancho Cucamonga, Calif.

[21] Appl. No.: 152,522

[22] Filed: Nov. 16, 1993

[51] Int. Cl.[5] ..... A61G 1/017; A47C 1/035

[52] U.S. Cl. ..... 280/250.1; 280/648; 297/DIG. 4; 5/81.1

[58] Field of Search ..... 280/250.1, 304.1, 642, 280/648, 657, 47.33, 643; 297/DIG. 4; 5/81.1

[56] References Cited

U.S. PATENT DOCUMENTS

| | | | |
|---|---|---|---|
| 531,330 | 12/1894 | Potter | 280/250.1 X |
| 2,682,913 | 7/1954 | Scheide | 5/81.1 X |
| 2,694,437 | 11/1954 | Glaser | 280/657 |
| 3,285,619 | 11/1966 | Kitrell et al. | 5/81.1 X |
| 3,495,869 | 2/1970 | Ingemansson | 5/81.1 X |
| 3,618,968 | 11/1971 | Greer | 280/250.1 X |
| 3,882,949 | 5/1975 | Anderson | 280/250.1 X |
| 3,936,893 | 2/1976 | Anderson et al. | 5/81.1 |
| 3,964,786 | 6/1976 | Mashuda | 280/250.1 X |
| 4,079,990 | 3/1978 | McMunn et al. | 5/81.1 X |
| 4,285,541 | 8/1981 | Onishi | 5/81.1 X |
| 4,453,732 | 6/1984 | Assanah et al. | 280/250.1 X |
| 4,632,450 | 12/1986 | Holdt | 297/DIG. 4 X |
| 4,655,471 | 4/1987 | Peek | 280/250.1 |
| 4,997,200 | 3/1991 | Earls | 280/304.1 X |
| 5,050,899 | 9/1991 | Stensby | 280/250.1 |

FOREIGN PATENT DOCUMENTS

| | | | |
|---|---|---|---|
| 5115509 | 5/1993 | Japan | 280/250.1 |

*Primary Examiner*—Margaret A. Focarino
*Assistant Examiner*—Florian Zeender
*Attorney, Agent, or Firm*—Monty Koslover

[57] ABSTRACT

A combination wheelchair/gurney comprising a three-part seat/gurney bed assembly, hingedly connected and pivotally mounted on a rigid metal rectangular frame, having two large side wheels for patient self-locomotion and two front caster wheels, and a seat support-/locking position mechanism which carries most of the seat weight and is pivotally mounted to the frame bottom. The wheelchair converts to a gurney by an attendant pulling back and downwards on the top back of the chair in a levered action, causing the seat/bed assembly to pivot at the top of the frame and raising it horizontally to the top of the frame to form a gurney bed. The gurney bed is at the approximate height of a typical hospital bed, making it easy to move a patient from the bed to the gurney. Side-rails attached to the two top sides of the frame, pivot up and are locked in position for gurney travel security.

2 Claims, 5 Drawing Sheets

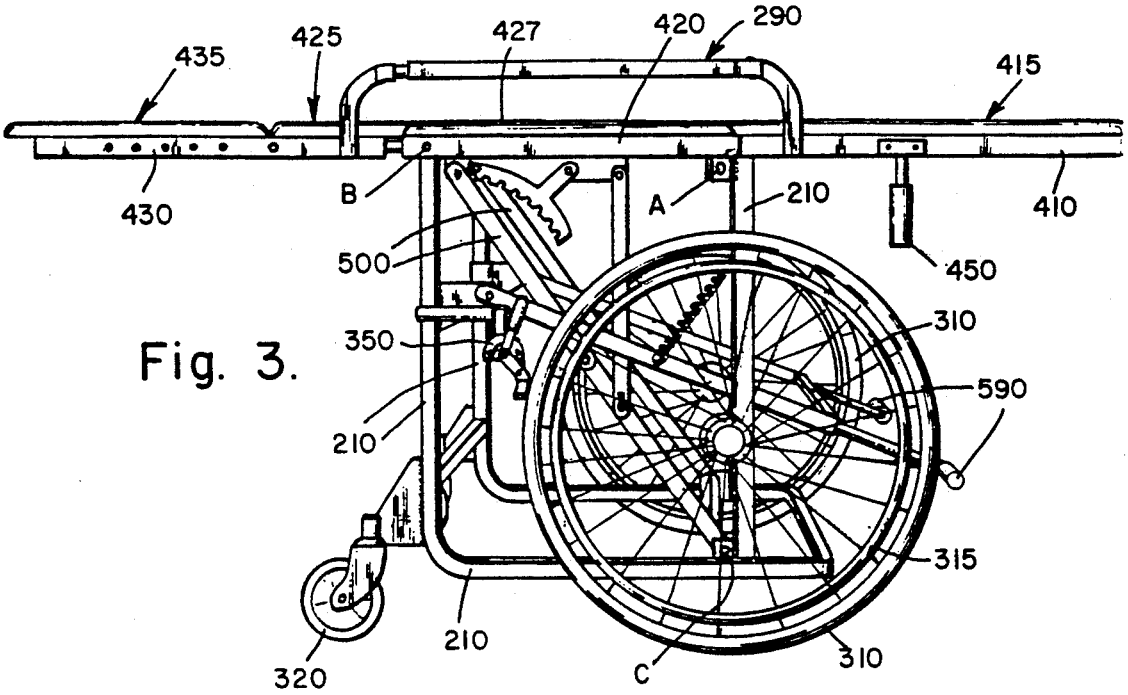
Fig. 3.
Fig. 4.
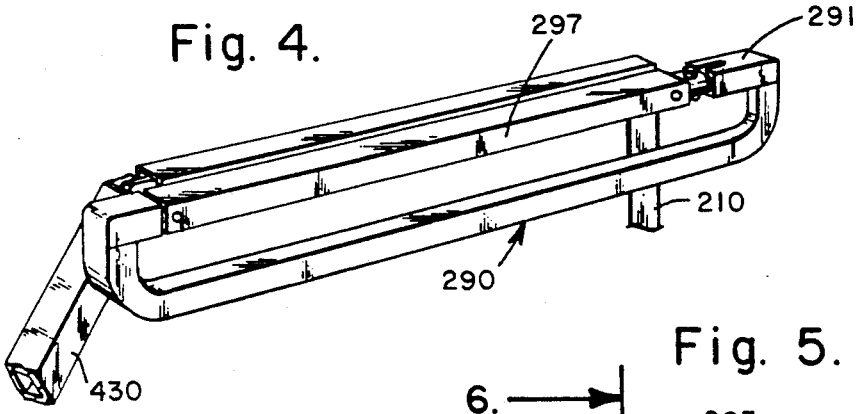
Fig. 5.
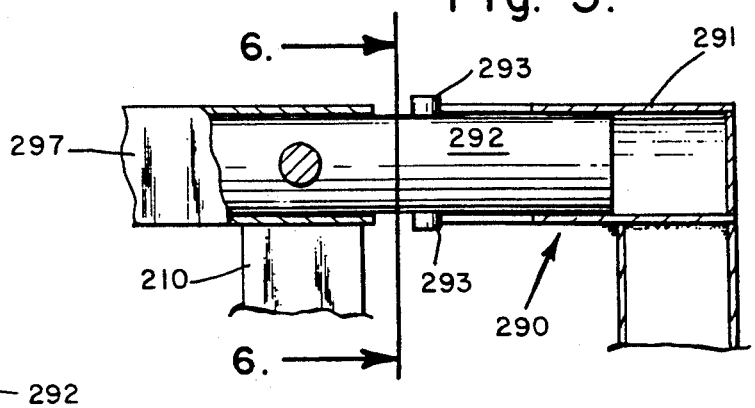
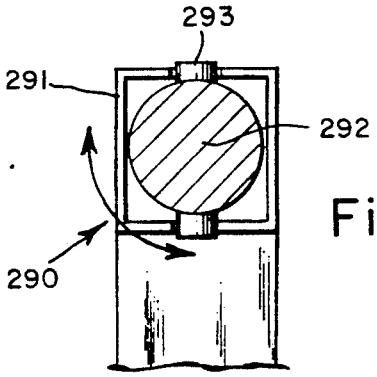
Fig. 6.

Fig. 7.
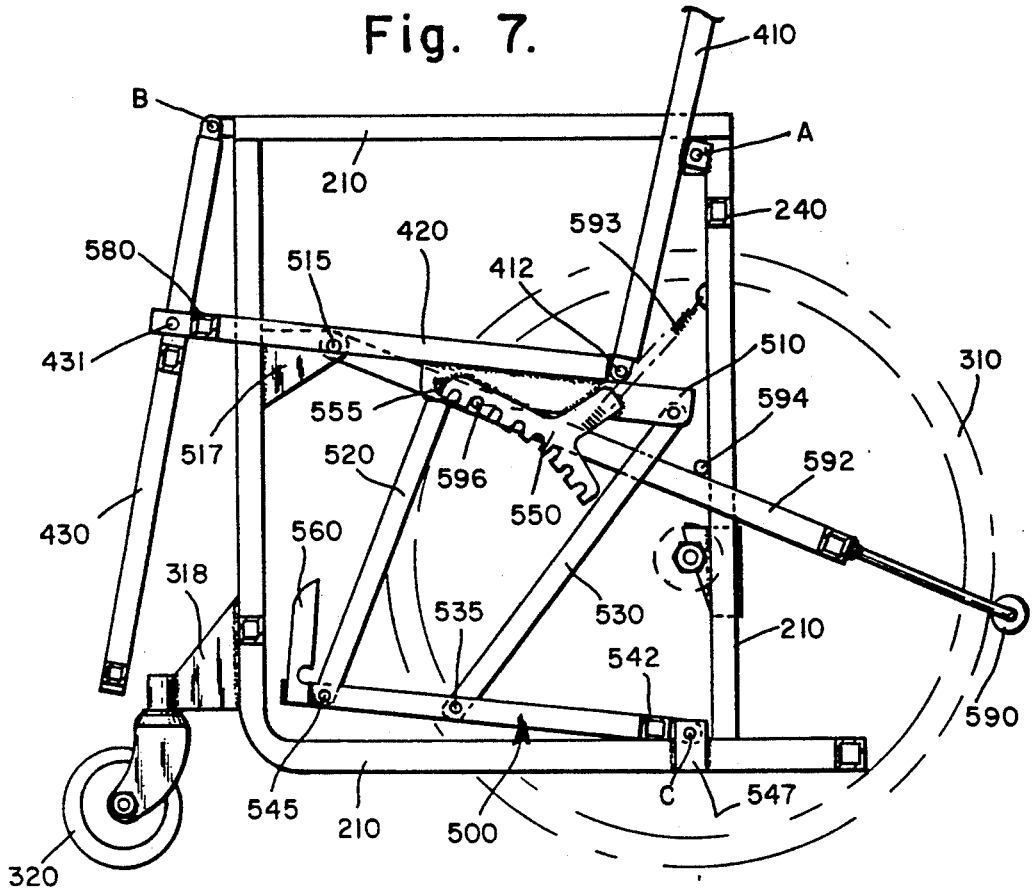
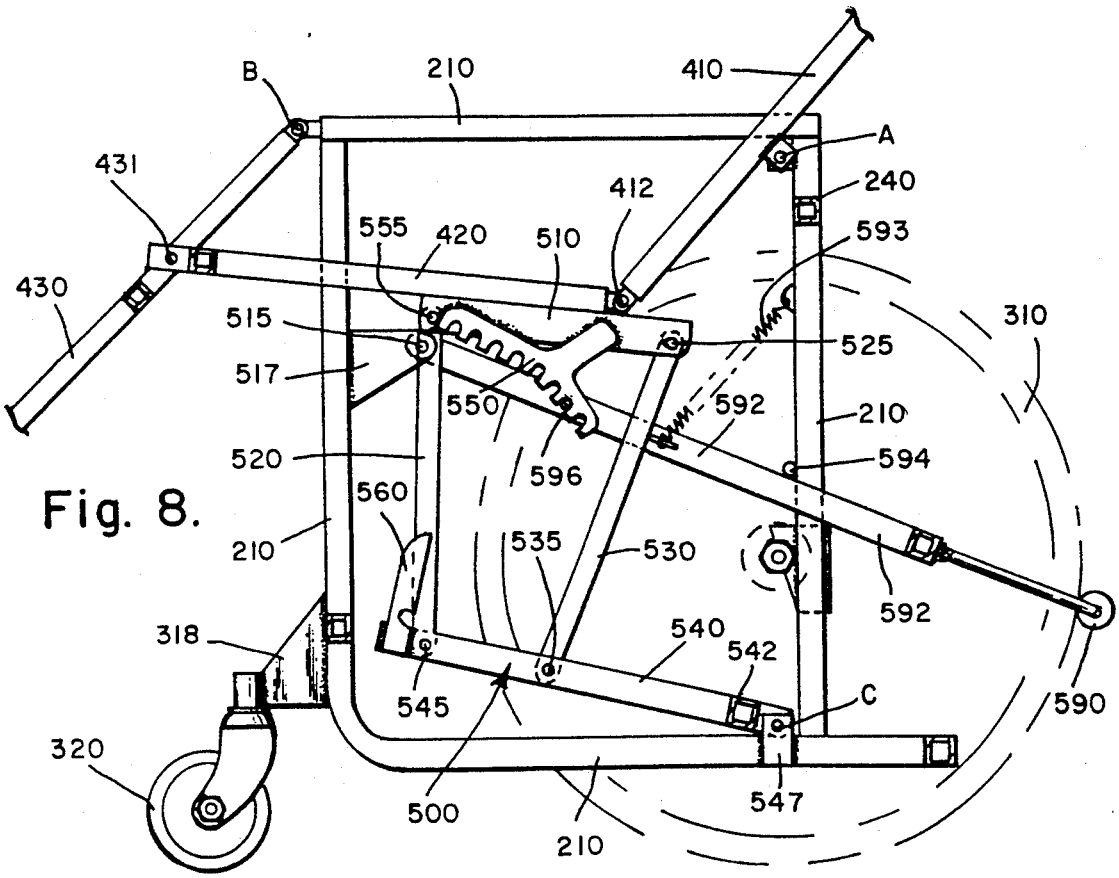
Fig. 8.

WHEELCHAIR/GURNEY

BACKGROUND OF THE INVENTION

This invention relates to a combination wheelchair/-gurney particularly adapted for use in a medical care environment such as a hospital or nursing home.

Hospital or nursing home patients who require the use of wheelchairs to get around, are often unable, because of physical disability, to move themselves from a bed into a chair or from a chair into a bed. Two attendants are generally needed to lift and move the patient. There is thus a need for a device where only one attendant is required to move the patient.

Gurneys are routinely used to transport patients in a prone position to and from medical procedure areas, whereas a standard design wheelchair allows a seated patient to wheel himself or herself around as desired. This attribute of standard design wheelchairs is particularly important in nursing homes, where patient perambulation is usually encouraged for convalescence. There is thus an ongoing need for both gurneys and standard wheelchairs. To date, this need has been satisfied by providing separate gurneys and wheelchairs, which constitutes considerable expense.

There are a number of inventions which purport to combine a wheelchair and gurney function in some manner. Typical of these are the patents of Abraham: U.S. Pat. No. 5,058,221, Stensby: U.S. Pat. No. 5,050,899, Hebert et al: U.S. Pat. No. 5,179,745, Earls: U.S. Pat. No. 4,997,200, and Holdt: U.S. Pat. No. 4,632,450. Abraham provides a wheelchair with a movable seat. It includes a movable platform for transferring a patient between a wheelchair and a bed or toilet. There is no provision for conversion to a gurney configuration.

Stensby provides a medical crash-chair adapted to form a gurney for transporting a patient. The chair includes a reclining backrest portion which is mechanically linked to an extension. The seat is slidably mounted on a base frame which has a very wide wheel base so that, according to the inventor, the chair may be placed over the foot of a treadmill, permitting an exhausted patient to collapse in the chair. The chair back can then be lowered and the leg portion raised by attendants, converting the chair into a gurney. The chair does not include any provision for raising the seat (and gurney platform) to hospital bed height. In addition, the chair is apparently not intended for use by the patient as a regular wheelchair since it does not include large side wheels for patient assisted locomotion.

Hebert et al provide an elevating convertible wheelchair which converts to a flat bed. The backrest hingedly pivots in relation to the seat portion to form a flat bed which is extended in length by adding an extension. There is no leg support portion, so that the patient would have to be lifted and slid backwards along the top of the flat bed in order to be supported in the prone position. An elevating means to elevate the seat is included, This elevating means is described as being a jacking mechanism such as hydraulic, pneumatic or electric elevating mechanism.

Earls describes a convertible wheelchair/gurney which includes a mechanism for :raising the patient seat level to a bed top level for transfer. The Earls invention includes movable extension to the lower wheelchair frame and an extra set of wheels to assist in properly supporting a patient in a gurney configuration.

Holdt describes a convertible wheelchair/gurney which has improvements in the areas of a cushioning cylinder that softens the lowering motion from the chair configuration to a litter configuration.

Neither Hebert, nor Holdt can be said to approximate a wheelchair configuration for a patient capable of moving himself/herself around and up and down hallways.

There is thus a need for a simple construction convertible wheelchair/gurney which raises the seat portion, back portion and leg portion to form a flat bed gurney without need for extensions or additional assemblies, or can be used as a standard wheelchair configuration for patient self-assisted perambulation.

SUMMARY OF THE INVENTION

The invention comprises a three-part seat/gurney bed assembly, hingedly connected and pivotally mounted on a rigid metal rectangular frame, having two large side wheels for patient self-locomotion and two front caster wheels, and a seat support/stop mechanism pivotally mounted to the frame.

The chair is converted to a gurney configuration by an attendant pulling back and downwards on the top back of the chair in a levered action, causing the seat/bed assembly to pivot on the top portion of the frame and raising the connected seat, leg and back assembly horizontally to the top of the frame to form a gurney bed. The gurney bed is at the approximate height of a typical hospital bed, making it easy to move a patient from the bed to the gurney. Side-rails attached to the two top sides of the frame, pivot up and are locked in position for gurney security.

Accordingly, it is a principal object of this invention to provide an equipment that will function equally well as a gurney and a conventional wheel chair for patient self-locomotion.

Another object is to provide an equipment that can be used to move, raise or lower a patient from a bed, requiring only one attendant to assist the patient.

It is another object to provide a convertible wheelchair/gurney which is relatively simple in construction and which utilizes no electrical, hydraulic or pneumatic mechanisms. Yet another object is to provide an equipment that is adapted for use equally well in hospitals and nursing homes to application as a wheelchair or gurney.

An advantage of the invention is its sturdiness and simplicity of construction relative to others, resulting in an ability to handle heavy patients without difficulty and at relatively low cost.

Further objects and advantages of the invention will become apparent from the study of the following portion of the specification, the claims and the attached drawings.

BRIEF DESCRIPTION OF THE DRAWINGS

FIG. 3 is a right-hand side elevation view of the device, illustrating the equipment ready for use as a gurney;

FIG. 4 is a perspective view of one of the two side-rail assemblies which are attached to the top portion of the main support frame; the side-rail is shown stored in a down position for equipment use as a wheelchair;

FIG. 5 is a partial view of one end of a side-rail assembly cut away to particularly show the mechanism by which the side rail is rotated to the upright position and locked in place when the equipment is used as a gurney;

FIG. 6 is a cross-section partial view of one end of a side-rail assembly taken along line 6—6 of FIG. 5;

FIG. 7 is a side elevation view of the left hand side of the device, taken along line 7,8,9—7,8,9 of FIG. 12, particularly illustrating the mechanism used for raising and lowering the seat portion; the seat is shown in a wheelchair configuration and parts not associated with the lifting mechanism or the frame are omitted for clarity;

FIG. 8 is a side elevation view of the left hand side of the device, taken along line 7,8,9—7,8,9 of FIG. 12, particularly illustrating the location and attitude of the raising/lowering mechanism when the seat is raised to a reclining position;

DESCRIPTION OF THE PREFERRED EMBODIMENT

Figure 1:
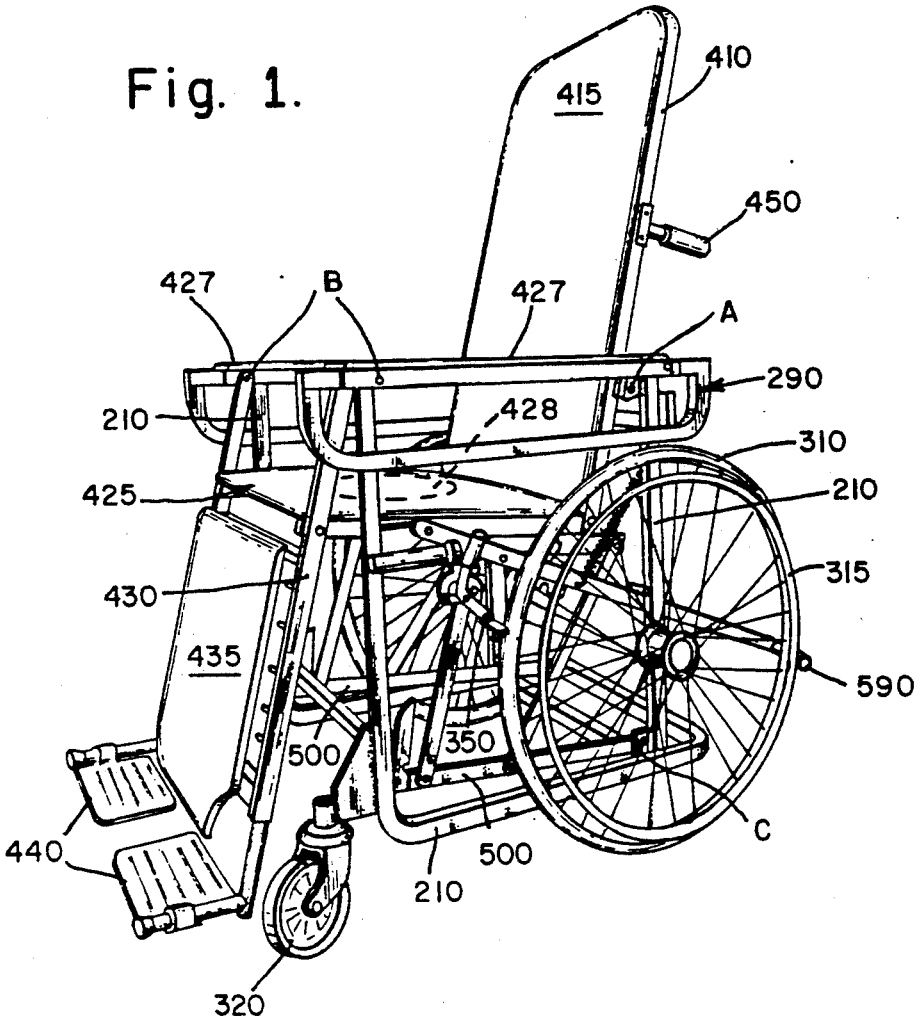
FIG. 1 is a perspective of the device, illustrating the equipment ready for use as a wheelchair; the left-hand and right-hand sides of the equipment, looking at its front, are symmetrical.
Figure 2:
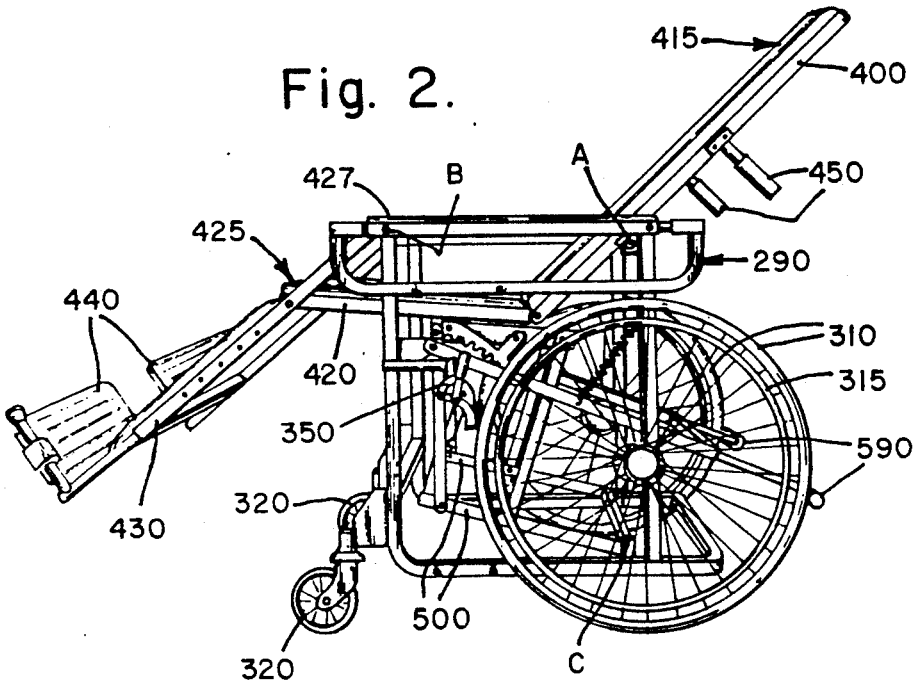
FIG. 2 is a right-hand side elevation view of the device showing the seat raised somewhat above the normal chair position and the back and leg portions fixed for a patient reclining position.

Referring particularly to the drawings, there is shown in FIGS. 1, 2 and 3, views of the preferred embodiment of a convertible wheelchair/gurney equipment. In FIG. 1, the equipment is shown ready for use as a wheelchair. FIG. 2 shows the equipment with the seat raised and the back and leg support panels at a recliner angle. FIG. 3 shows the equipment ready for use as a gurney.

Referring to FIGS. 1, 2 and 3, the equipment invention comprises a rigid, box type main support frame 210, a back-support panel 410, seat panel 420 and leg-support panel 430 which are pivotally connected together and are pivotally mounted to the frame sides, two swivellable foot plates 440 attached by an extension to the bottom of the leg-support panel 430, two large side wheels 310 mounted one on each side of the frame, two small caster wheels 320 mounted one on each side at the lower front of the frame, a seat-support and locking position means 500 which is pivotally mounted to the bottom frame 210 portion at point C and fastened to the underside of the seat panel 420, two movable side rail assemblies 290 mounted and fixed one to each side of the top of the frame, two standard wheel-stop levers 350 and two handles 450 projecting from the back of the back-support panel 410.

Both of the large side wheels 310 have a large diameter metal ring 315 mounted on the outside of the wheel to serve as a pushing rim for patient chair self-propulsion.

All the wheelchair/gurney component parts are shown in the drawings FIGS. 1-13 although some parts are omitted in various views for the sake of drawing clarity.

To raise a patient from a sitting position in the chair to lying down on a flat bed gurney, an attendant first pushes his foot down on one of the two locking arm release pedals 590, and while holding the pedal down, pulls the top of the back support panel 410 downwards and backwards. The back support panel 410 and leg support panel 430 pivot on the frame 210 at the frame top back corners A and top front corners B. The levered position of the seat panel 420 with respect to the pivot points A, B, and its hinged connections to back and leg support panels 410, 430, causes the seat panel to rise as leverage is applied to the back support panel and the back and leg support panels rotate about the pivot points. The attendant continues to pull down on the top of the back support panel 210 until it is horizontal. He then removes his foot from the locking arm release pedal 590 and the seat support mechanism 500 will immediately lock the seat panel 420, back panel 410 and leg support panel 430 in place in a flat bed gurney operation. It should be noted that the seat support mechanism 500 provides a means of locking the seat at any position during its rise, so that a reclining seat attitude as shown in FIG. 2 can be selected. The seat support mechanism 500 also carries most of the weight on the seat panel 420, ensuring that relatively little weight is placed on the pivots connecting the back, seat and leg panels to the frame 210. This aspect is particularly important when the equipment is used to transport heavy patients weighing in excess of 200 pounds; a not uncommon event in nursing homes.

After the seat is raised to the gurney configuration, the stored side-rails 290 may be rotated upwards and locked in the up position for patient security as shown in FIG. 3.

Figure 12:
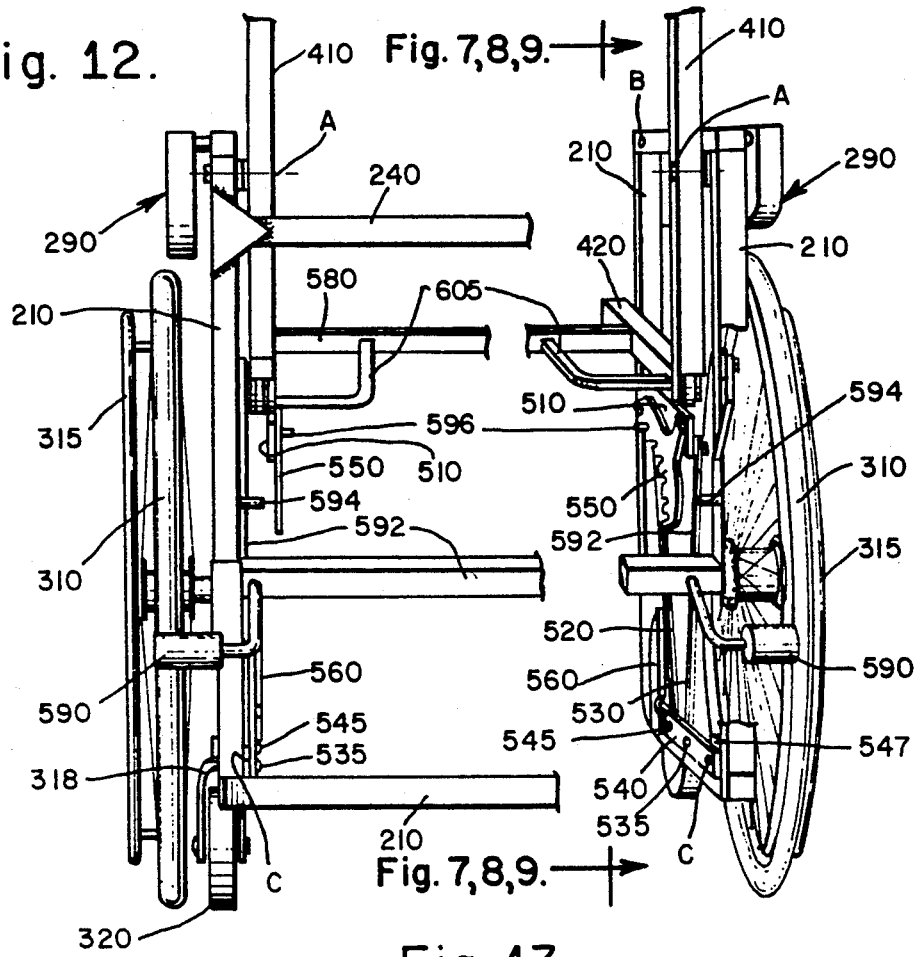
FIG. 12 is a split elevation view seen from the back of the device; the device left-hand side is shown separated and is in perspective for clarity; parts of the seat, back and leg portions are omitted for clarity.
Figure 13:
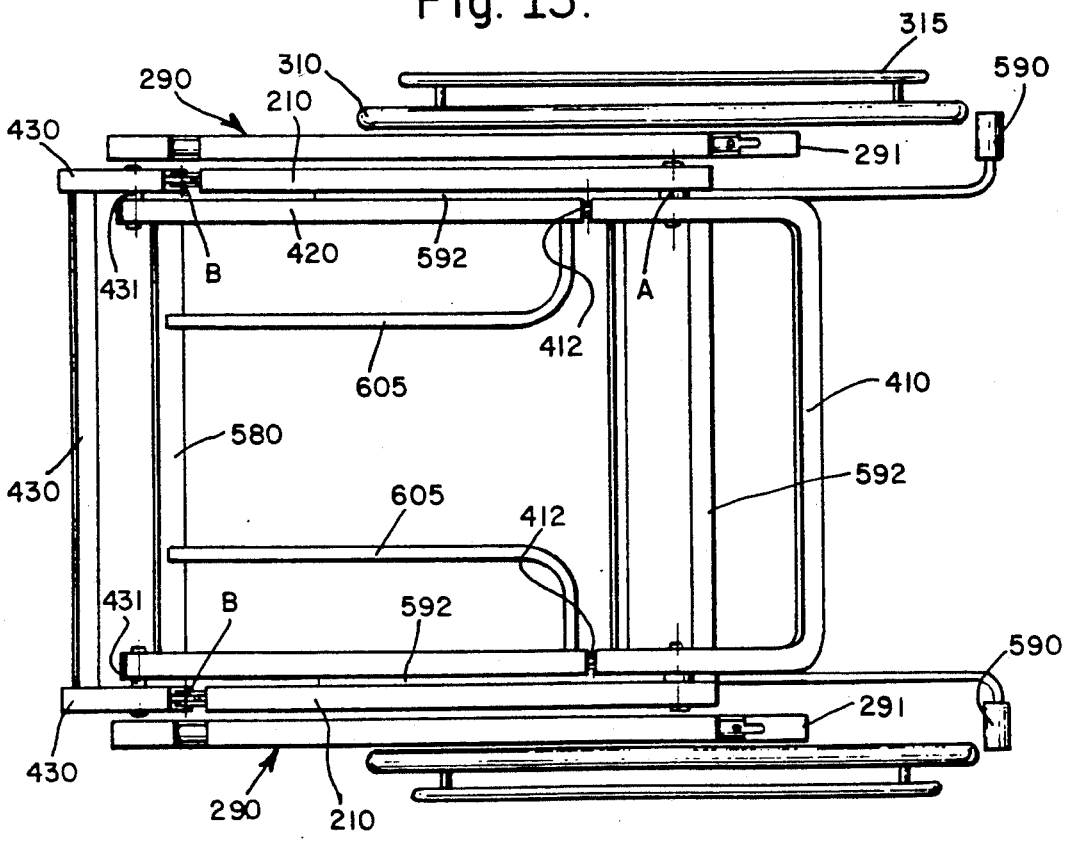
FIG. 13 is a top plan view of the device, with the seat, back, leg and armrest padding omitted for clarity; the equipment is shown in the wheelchair configuration, particularly illustrating the rails on which a potty-holder assembly or potty cut-out seat assembly may be mounted.

The equipment includes a back pad 415, a seat pad 425, and a leg support pad 435. These pads are attached to their respective panel frames and are removable, available pads, well known in the prior art. Similarly, two armrest pads 427 are provided and attached to the top portion of the frame 210 which forms an armrest. The armrest pads are also conventional in design, removable and available from manufacturers. The seat pad 425 is cut out at its center surface in a potty hole shape. This potty hole is either filled with a fitting seat portion 428 mounted on a removable holder assembly 600 underneath the seat, or the hole is occupied by a potty mounted on a holder assembly. The means by which the removable holder assembly 600 is held in place under the seat is illustrated in FIGS. 12 and 13 which will be discussed later.

Referring again to FIGS. 1, 2 and 3, the main support frame 210 is formed from stainless steel channel bent in a U shape and welded to straight channel pieces to form a rigid box construction on all except the top portion. At the top of the two parallel sides, a stainless steel channel is welded to each vertical member of the frame, forming part of an armrest as well as a frame support. Cross member channels are welded between the vertical frame members from side to side to add strength and frame rigidity. The two front caster wheel assemblies 320 are welded to the lower portion of the frame 210 front vertical members, and the hubs of the large side wheels 310 are fastened to supports welded to the frame 210 rear vertical members. A wheel stop lever 350 is welded to the side of the right front vertical frame member, so as to impinge on the wheel tire surface when it is activated, serving as a brake. This wheel stop arrangement is well known in the prior art.

The back support panel 410, the seat panel 420 and the leg support panel 430 are all constructed from stainless steel channel to form the panel frames. Cross braces are used as stiffeners for the panels. In the case of the leg support panel 430, the panel side rails are extended well beyond the padded area, projecting to the top of the main support frame 210 for fastening by pivot pins to the frame.

The back support panel 410 length is made so that a seated patient's head is fully supported by the panel which projects a little above the head. This is done to ensure complete patient support when used as a gurney. It also provides the maximum leverage for an attendant raising the seat with a seated patient. Experience has shown that it is relatively easy to lift a 185–200 pound patient using the leverage provided by the back support panel 410.

Referring now to FIGS. 4, 5 and 6, there are shown a perspective view of a side-rail assembly, a partial cut-away view of one end of the assembly and a cross-section view of one end. The side-rail assembly comprises a straight length channel arm-rest member 297, a rail member 290 formed from channel with a long straight length and having a short portion at each end bent at 90 degrees to its long axis, two short straight pieces of channel 291 welded to the bent ends of the rail member 290, and a rod 292 which is located inside the arm-rest member 297 and protrudes substantially out the ends of the arm-rest member 297. As shown in FIG. 4, the arm-rest member 297 is bolted to the top cross member of the main support frame 210 to form an armrest. The rail member 290 and its welded end pieces 291 have the ends of the rod 292 inserted slidably in each end, so that the rail 290 can pivot around the rod 292 axis. A pin 293 extending through one end of the rod as shown in FIGS. 5 and 6, and a slot cut in one rail end piece 291 are used to lock the rail in place whether up as for the gurney configuration or down for storage.

Figure 9:
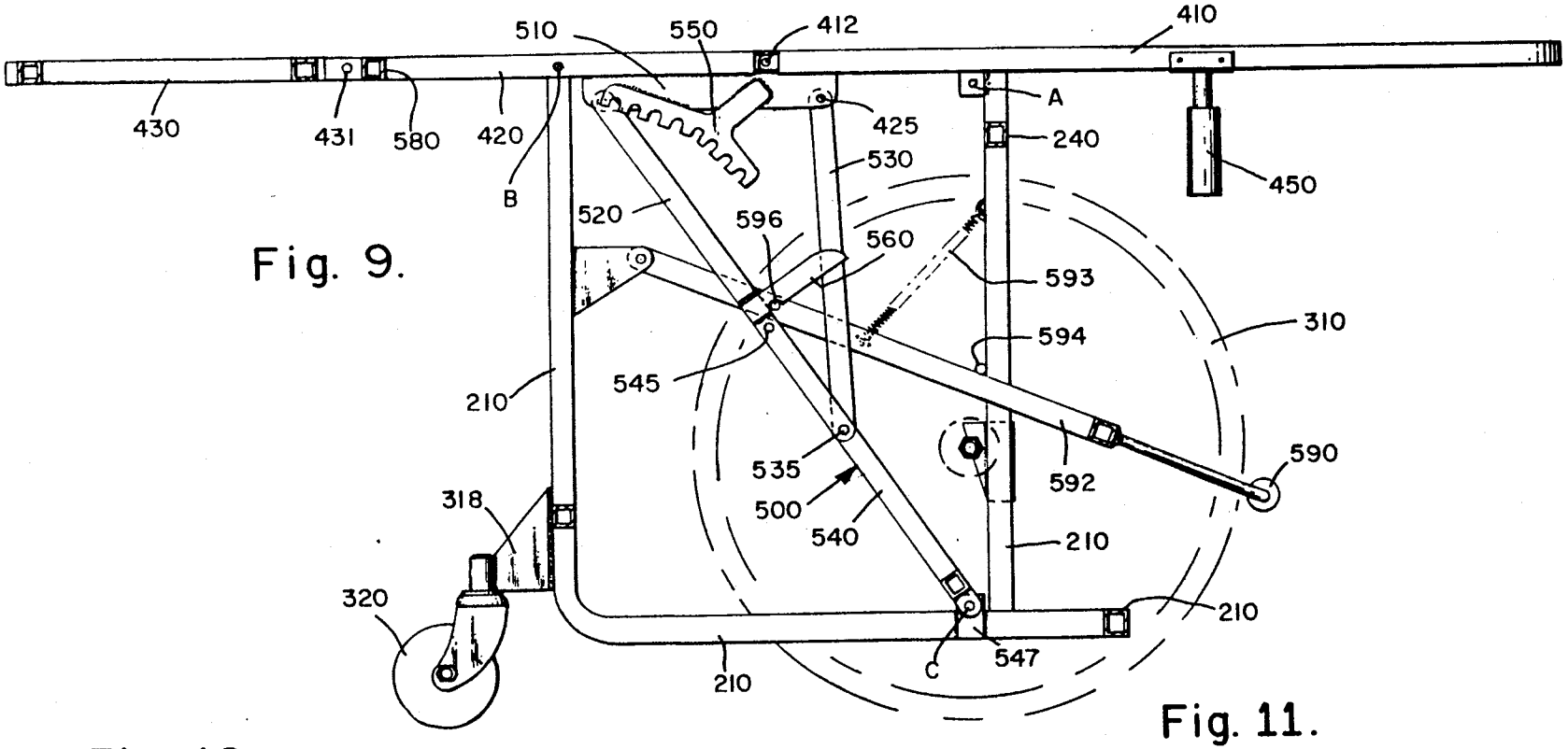
FIG. 9 is a side elevation view of the left hand side of the device, taken along line 7,8,9—7,8,9 of FIG. 12, particularly illustrating the location and attitude of the raising/lowering mechanism when the seat is fully raised to a gurney configuration.

Referring now to FIGS. 7, 8 and 9, there are shown three side elevation views of the left-hand side of the equipment taken along line 7,8,9—7,8,9 of FIG. 12. These views show the equipment side construction from a cut taken, slicing the back, seat and leg panels at a location near the left-hand side. The drawings depict the left main frame 210 portion, a partial depiction of the back panel 410, seat panel 420 and leg support panel 430 structures, and the relation of the seat-support and locking means 500 to the frame and seat structures. Parts such as the seat, back, leg and armrest pads are omitted for the sake of clarity. The objective here is to illustrate the working and construction of the seat-support and locking means 500 in performing its function.

It is useful to use the following convention when discussing the seat-support and locking means: The "forward" direction is taken to mean to the left of the drawings (the front wheel 320 location), while the "rearward" direction means to the right of the drawings (the large side wheel 310 location). The seat-support and locking means 500 acts in a plane parallel to the side of the main support frame 210 and moves forward and rearward as well as up and down.

The preferred mechanical embodiment of the seat-support and locking means 500 comprises two symmetric mechanisms, one on each side of the wheelchair gurney, which are joined in parallel by cross-bars to ensure simultaneous operation. The seat-support portion of each mechanism comprises: a top strut 510 which is welded to the underside of the seat panel 420, front and rear vertical struts 520, 530 which are pivotally connected to each end 525, 555 of the top strut 510, a bottom strut 540 which is pivotally connected to the lower distal ends 535, 545 of the front and rear vertical struts and also extends and connects to a lower frame pivot point C (547). As shown in the drawings, the aforementioned struts are connected to form a pivotable trapezoid which can pivot its aspect forward or rearward, depending on whether the top strut is raised or lowered. Referring to FIGS. 7, 8 and 9, it can be seen that the trapezoid leans rearward when the chair seat 420 is down (FIG. 7), straightens out and leans forward as the seat 420 is caused to rise (FIG. 8), and is fully forward, becoming a triangle when the seat is fully raised to the gurney position.

At all times, the weight on the seat panel is supported directly by the trapezoidally joined struts and is transmitted to the lower frame at welded connection plate 547 through pivot connection C, providing strong support to the seat panel.

The locking portion of the mechanism comprises a first notched member 550, a second notched member 560, a locking arm 592 which interacts with the notched members, and a spring 593.

The first notched member 550 is flat and curved forming approximately 30 degrees of arc. Along the curved edge are located a multiplicity of notches corresponding to a predetermined seat height. The notched member 550 is welded to the side of the seat support top strut 510 with its left or forward end, near the forward pivot 555 of the top strut and fixed so that it curves downward in approximately 30 degrees of arc. The second notched member 560 is a short length of metal which has one notch in its edge and is welded to the free (forward) end of the bottom strut 540 at 90 deg. to the bottom strut, but in the same plane.

The locking arm member 592 is a long flat sided metal strip which is pivoted at one end on a metal plate 517 that is welded to the forward vertical portion of the frame 210. The distal free end of the locking arm member 592, is welded at 90 degrees to a channel member which serves as a crossbar connection to a second locking arm in parallel at the opposite side of the chair.

Attached perpendicular to the locking arm crossbar and parallel with the locking arm 592, are two L shaped rods made of metal tubing. Each L shaped rod has a pedal formed on its short end and serves as a seat support release pedal 590 at both sides of the wheelchair. Locking action is provided by a pin 596 protruding from the side of the locking arm member 592, and located so that the pin 596 can engage with any of the notches in the first notched member 550 when the locking arm is raised, or can engage with the notch in the second notched member 560 at the maximum seat panel height.

A spring 593 is attached to the locking arm member 592 and to the rear vertical frame portion 210, constantly pulling upwards on the looking arm member 592. A stop pin 594 is attached to the frame to limit upward travel and rotation of the locking arm member.

As shown in FIG. 7, when in the wheelchair mode, the locking arm pin 596 slips into one of the leftmost notches of the curved notched member 550 under the seat. In this position, the seat support trapezoidal portion is held rigid and can not be moved. Similarly, as shown in FIG. 8, when the looking arm 592 is first released from the notched member 550 and the seat is partially raised by an attendant, the locking arm pin 596 slips into one of the remaining notches, depending on the forward movement of the trapezoidal portion. Again, the seat support trapezoidal portion is held rigid and can not be moved.

In the case of the gurney mode, depicted in FIG. 9, the locking arm pin 596 no longer engages with any of the notches in the first notched member 550. Instead, the pin 596 engages with the single notch in the second notched member 560 which also maintains the support struts rigid. It should be noted that in this configuration, both the forward vertical strut 520 and the bottom strut 540 are in line, joined by a pivot connection 545. The second notched member 560, which is welded to the bottom strut 540, then performs the function, in combination with the locking arm, of keeping the two forward and bottom struts rigidly in line.

In each of the three seat configurations shown in FIGS. 7, 8 and 9, the back panel 410 pivots about point A at the rear top corners of the frame 210, the leg support panel 430 pivots about the front top corners of the frame at the armrests, and the seat panel 420 pivots about and between the back panel 410 and the leg support panel 430. The seat support mechanism does not raise the seat; it supports the seat when the seat movement is stopped.

Figure 11:
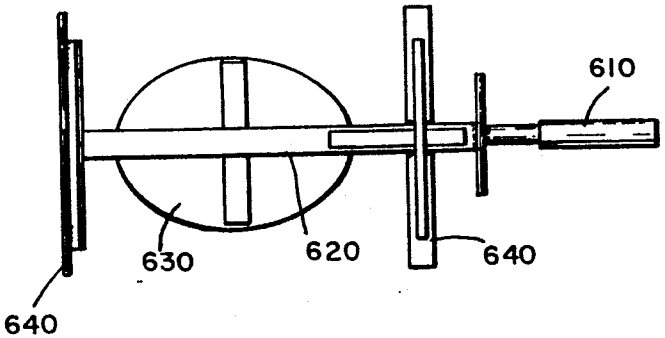
FIG. 11 is a bottom plan view of the potty cut-out seat replacement assembly.
Figure 10:
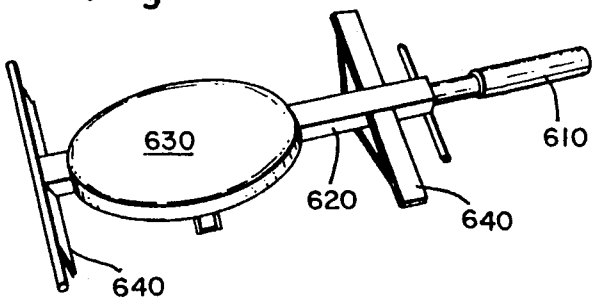
FIG. 10 is a perspective view of the potty cut-out seat replacement assembly.

Refer now to FIGS. 10 and 11. There are shown two views of a typical removeable potty seat holder which rides on rails under the chair seat. In the illustrations, the holder is holding an oval shaped seat pad cutout 630 which is used to fill the seat cutout hole 428 shown in FIG. 1. The holder is made from a piece of metal channel 620 having a tubing extension 610 welded on to provide a handle. Two metal bars 640 are welded in parallel across the channel member 620 at each end to provide support. The bars 640 are stepped at each end to locate the holder on the chair potty support rails which are under the chair seat.

Holders having the same approximate physical attributes, but supporting a potty rather than a seat pad, are well known and available in the prior art. They can be adapted to fit on the rails under the chair. Thus either type of potty holder can be used under the chair as needed.

Referring now to FIGS. 12 and 13, there are shown split, partial views of the back of the wheelchair/gurney and a top plan view, with the pads removed. These views offer a means of describing parts that are otherwise obscured. In FIG. 12, the right side of the drawing, which is the equipment left-hand side, is shown in perspective to help in understanding the location and interaction of the seat support and looking means mechanism which is located close to either side and joined by cross bars. That both the equipment sides are symmetrical in construction is evident from the drawings.

The back of the main support frame 210 has two large, rigid cross members. A top cross-member 240 is welded to both sides of the frame using two metal gussets for added torsional strength. The bottom cross-member is part of the frame 210 channel tubing which is bent at 90 degrees to the side frame portions. It can be seen that the two locking arm release pedals 590 are attached to the same channel cross bar 592 connecting the left-hand looking arm to the right-hand locking arm. Two L-shaped rails 605, spaced a distance apart are welded to the inside surfaces of the seat panel 420 frame. The forward end of the rails is joined to the seat cross brace 589 while the smaller end of the L is joined to the sides of the channels forming the seat panel 420 sides. The two rails 605 function as a support for a potty holder shown in FIGS. 10 and 11 or its equivalent, permitting a potty holder to be easily inserted in place or removed as required.

The foregoing drawings do not show various prior art attachments to the wheelchair/gurney, such as a holder fixture for an intravenous bottle. These attachments are well known optional additions which may be added as required by the user.

Regarding the materials of construction, it is preferred that all external metal parts be made of stainless steel, since this is generally mandated by hospitals and nursing homes for sanitary reasons. However, equivalent strength, coated materials may be used wherever the user does not require stainless steel.

It should be noted that the wheelchair/gurney as described is sized to move easily in hospitals and nursing homes. This offers a considerable advantage over those embodiments which are sized and shaped for only particular environments such as examination rooms.

From the above description, it is apparent that the preferred embodiment achieves the objects of the present invention. Alternative embodiments and various modifications of the embodiments depicted will be apparent from the above description to those skilled in the art. These and other alternatives are considered to be within the spirit and scope of the present invention.

Having described the invention, what is claimed is:

1. A combination wheelchair-gurney apparatus comprising:

a wheelchair support frame made of metal tubing shaped to form two rectangular shaped frame sides designated as a left side and a right side, each said frame left and right side having a top frame horizontal member, a front frame vertical member, a bottom frame horizontal member and a rear frame vertical member, said left and right frame sides being parallel and spaced apart and rigidly connected to each other by horizontal metal tubular cross members for strength;

an articulated back, seat and leg rest assembly comprising a back support panel pivotally connected to a seat support panel which in turn is pivotally connected to a leg support panel, said back support panel being mounted pivotally between said frame left and right side top horizontal members at a location near the back end of said top horizontal members, said leg support panel having extended portions which are mounted pivotally between said frame left and right side top horizontal members at a location near the front end of said top horizontal members; a first means for movable seat support and seat height locking position pivotally mounted to said bottom frame horizontal member on each said frame left and right side; a second means for foot operated release of said first means from a locked position, permitting said seat support panel to be raided or lowered;

a pair of hand grip side rails mounted to said frame top horizontal members; a pair of swivellable front wheels mounted to said front frame vertical members near the bottom of said vertical members and a pair of large diameter side wheels mounted one to each said frame right and left side;

said first means for movable seat support and seat height locking position including two identical mechanical linkage means and two pairs of locking elements, each located on said wheelchair support frame on said left and right sides of said support frame;

each said mechanical linkage means comprising: a top horizontal strut welded to said seat support panel parallel with the sides of said wheelchair support frame, a front vertical strut pivotally connected to a first end of said top horizontal strut, a rear vertical strut pivotally connected to a second end of said top strut and a bottom strut pivotally connected to the lower ends of said front and rear vertical struts; said top, front, rear and bottom struts forming a movable trapezoid; said bottom strut being extended and pivotally connected to said bottom frame horizontal member, thereby transmitting any weight applied to said seat ;support panel, through said trapezoid directly to said wheelchair support frame; said trapezoid being pivoted forwardly and backwardly along the axis of said top horizontal strut as said seat support panel is moved up or down;

each pair of said locking elements comprising a first notched member and a second notched member; said first notched member being a flat metal plate, shaped and curved in an arc of about 30 degrees having an inner and outer radial edge and having a multiplicity of notches formed on said inner radial edge; said first notched member being welded to said top strut under said seat support panel in a configuration such that said first notched member describes about 30 degrees of arc downwards in a vertical plane; said first notched member being thereby located so that said multiplicity of notches each correspond to an angle and height of said seat panel underneath which said first notched member is welded; said second notched member being a short, flat metal strut having a single notch in one edge, and being welded at one end to an end of said bottom horizontal strut of said mechanical linkage means at an angle of 90 degrees;

said second means for foot operated release of said first means from a locked position includes a pair of mechanical locking arm levers, each said lever being pivoted at an end thereof to one of the front vertical members of said support frame and movable by application of manual pressure to the free end of said lever; each said locking arm lever including a pin affixed at a distance from its pivot end such that said pin may engage with either of said first notched member or said second notched member; said locking arm lever including a spring which is attached to said lever and to said support frame, providing upward pressure on said lever and keeping said pin engaged with said first or second notched members;

whereby said second means for foot-operated release interacts with said first means for movable seat support to maintain said seat support panel in a fixed position and to release said first means for movable seat support from a locked seat position by application of manual pressure;

whereby said first means for movable seat support may be used by an attendant operator to place said wheelchair-gurney apparatus in a gurney configuration having said articulated back, seat and leg rest assembly in a horizontal position, and to place said wheelchair-gurney in a wheelchair configuration.

2. The apparatus as defined in claim 1, wherein: said hand grip side rails include means for rotating and locking said hand grip side rails in an upward position for patient security during gurney use and in a downward position for storage during wheelchair use.

* * * * *